US009803388B2

(12) United States Patent
Cunningham

(10) Patent No.: US 9,803,388 B2
(45) Date of Patent: Oct. 31, 2017

(54) PNEUMATIC POST DRIVER

(71) Applicant: Roger Cunningham, Grass Lake, MI (US)

(72) Inventor: Roger Cunningham, Grass Lake, MI (US)

(73) Assignee: Striker Tools, Ann Arbor, MI (US)

( * ) Notice: Subject to any disclaimer, the term of this patent is extended or adjusted under 35 U.S.C. 154(b) by 716 days.

(21) Appl. No.: 14/209,336

(22) Filed: Mar. 13, 2014

(65) Prior Publication Data

US 2014/0262399 A1 Sep. 18, 2014

Related U.S. Application Data

(60) Provisional application No. 61/788,019, filed on Mar. 15, 2013.

(51) Int. Cl.
*E04H 17/26* (2006.01)

(52) U.S. Cl.
CPC ..... *E04H 17/263* (2013.01)

(58) Field of Classification Search
CPC ..... E04H 17/263
USPC ..... 173/200
See application file for complete search history.

(56) References Cited

U.S. PATENT DOCUMENTS 152,391 A 6/1874 Manson
323,053 A 7/1885 McCoy
326,312 A 9/1885 McCoy
348,870 A 9/1886 Trump
1,813,546 A 7/1931 Schindler
3,193,026 A 7/1965 Kupka
3,547,207 A 12/1970 Warrington
3,645,342 A 2/1972 Wandell
3,838,741 A 10/1974 Pepe
3,866,690 A * 2/1975 Lance ..... B25D 9/12 173/127
3,991,833 A * 11/1976 Ruppert ..... E02D 13/10 173/131

(Continued)

FOREIGN PATENT DOCUMENTS

AU 2003100824 A 11/2003
AU 2004210575 A 5/2005

(Continued)

*Primary Examiner* — Hemant M Desai
*Assistant Examiner* — Valentin Neacsu
(74) *Attorney, Agent, or Firm* — Endurance Law Group PLC

(57) ABSTRACT

A pneumatic post driving apparatus comprises an internal cylinder chamber within which a hammer piston is reciprocated. The hammer piston strikes against an anvil, which in use is abutted against the top of a post to be driven. Kinetic energy from the descending hammer piston is transferred through the anvil into driving energy for the post. An air control system alternately routes pressurized air between the top and bottom ends of the cylinder to move the hammer piston up and down. The air control system includes a spool-type control valve disposed for sliding movement within a control body. The anvil is resiliently suspended at the bottom of the cylinder chamber by an annular retention flange that has a conically tapered under surface. A lower elastomeric pad fits against the tapered under surface of the retention flange in direct surface-to-surface contact.

10 Claims, 16 Drawing Sheets

(56) References Cited

U.S. PATENT DOCUMENTS 4,020,744 A * 5/1977 Swenson ..... E02D 7/10 91/216 B
4,072,199 A * 2/1978 Wanner ..... B25D 17/24 173/131
4,079,793 A * 3/1978 Mosely ..... E21B 4/14 173/132
4,262,755 A * 4/1981 Kuhn ..... E02D 7/10 173/131
4,314,613 A 2/1982 Kuhn
4,362,216 A * 12/1982 Jansz ..... E02D 13/10 173/131
4,366,870 A 1/1983 Frederick
4,377,355 A 3/1983 Chelminski
4,383,582 A 5/1983 Chelminski
4,416,338 A * 11/1983 Nelson ..... B25D 9/16 173/169
4,429,751 A 2/1984 Jackson et al.
4,476,941 A * 10/1984 Buck ..... B25D 17/06 173/117
4,497,376 A 2/1985 Kurylko
4,523,647 A * 6/1985 Last ..... E02D 7/125 173/128
4,693,322 A 9/1987 Gartside
5,601,149 A * 2/1997 Kawasaki ..... B25B 21/02 173/109
5,727,639 A 3/1998 Jeter
5,806,608 A 9/1998 DuBois
6,619,407 B1 9/2003 Hawkins et al.
6,626,247 B1 * 9/2003 Nordlin ..... E02D 13/00 173/114
6,776,242 B1 * 8/2004 Cunningham ..... E04H 17/263 173/124
7,314,098 B2 1/2008 Miller
7,926,690 B1 4/2011 Tippmann, Sr.
2006/0254789 A1 * 11/2006 Murakami ..... B25B 21/026 173/210
2008/0087448 A1 * 4/2008 Happ ..... B25B 23/0035 173/93
2009/0321100 A1 * 12/2009 Andersson ..... B25D 9/18 173/1
2010/0012336 A1 * 1/2010 Adamson ..... E02D 7/02 173/1
2011/0155403 A1 * 6/2011 Rohrer ..... E04H 17/263 173/114
2012/0111593 A1 * 5/2012 O'Toole ..... E04H 17/263 173/90

FOREIGN PATENT DOCUMENTS

AU WO 2010091458 A1 * 8/2010 ..... E04H 17/263
AU 2010213348 A 8/2011
CA 2751909 A 8/2010

* cited by examiner

PNEUMATIC POST DRIVER

CROSS REFERENCE TO RELATED APPLICATIONS

This application claims priority to Provisional Patent Application No. 61/788,019 filed Mar. 15, 2013, the entire disclosure of which is hereby incorporated by reference and relied upon.

BACKGROUND OF THE INVENTION

Field of the Invention

The invention relates generally to pneumatic post drivers

Description of Related Art

Posts must be driven into the earth for a wide variety of applications. One common post application is the erection or repair of fencing. Another common application is in the staking of trees and other guyed objects. Indeed, many other applications exist that call for the placement of posts of the various types including, but not limited to T Posts, Channel Posts, C Posts, Delineator Posts, Pipe, Sand Points, Ground Rods, Anchors, Z Posts, Large Tent Pegs, I Posts, W Posts, Concrete Form Pins, Beams, Round, Square or Rectangular Tubing, Wood Posts, Stakes, etc. For the sake of convenience, all post types will be generically referred to herein as simply posts or fence posts regardless of the end application.

Driving options typically include mallets and sledge hammers, a weighted tripod rig, manual post drivers of the type that include a tubular guide or sleeve that fits over the upper end of a post and is raised and then forcibly brought down upon the post to deliver repeated driving impacts, pneumatic post drivers, hydraulic post drivers, pile drivers, as well as a variety of make-shift tractor and power-tool techniques. Factors that influence a person toward one or more of these driving options include the number of posts needing to be driven, the relative heath and strength of the individual, the type of soil into which the post must be driven, the availability of a portable/extendable power supply, budget, site accessibility, and the like.

When a large number of posts need to be driven, or even a few number but the soil conditions are adverse, a power-driven device, such as a pneumatic or hydraulic unit may be indicated to drive the posts into the ground. Most power-driven devices of this type are large, heavy and expensive units often mounted on trucks, trailers or cranes for portability. These devices sometimes require multiple operators and considerable set-up time. They are often expensive and unwieldy.

Light duty powered devices for driving posts are disclosed in U.S. Pat. No. 6,667,242 to Cunningham, issued Aug. 17, 2004. The Cunningham patent discloses a post driver that includes a piston which rests at all times atop a post to be driven. The piston is housed within a weighted cylinder that is raised for each stroke pneumatically and falls by gravity with or without an optional spring or user assist. The entire disclosure of U.S. Pat. No. 6,667,242 is hereby incorporated by reference and relied upon. While the post driver disclosed in U.S. Pat. No. 6,667,242 is both effective and commercially successful, there remains a need for improved power post driving devices that are versatile in terms of the post sizes with which it can be used, that can be remotely operated from an elevated position atop of long post while the operator remains standing on the ground, and that does not incorporate complicated switching components susceptible to breakage or frequent maintenance.

Other examples of prior art post drivers may be observed in U.S. Pat. No. 348,870 to Trump issued Sep. 7, 1886, U.S. Pat. No. 3,838,741 to Pepe issued Oct. 1, 1974, and U.S. Pat. No. 4,429,751 Jackson issued Feb. 7, 1984. Trump (U.S. Pat. No. 348,870) discloses a valve-less, double-acting pneumatic hammer. The routing of air between top and bottom ends of the cylinder is determined entirely by position of the hammer piston. The hammer piston hits against an anvil that is spring-mounted in the bottom of the cylinder housing. Pepe (U.S. Pat. No. 3,838,741) also discloses a double-acting pneumatic hammer in one embodiment. Air is routed between top and bottom ends of the cylinder based entirely on the position of the hammer piston. There is no external air control valve. The hammer piston hits against an anvil that is supported by shock absorbing spacing shims. Jackson et al. (U.S. Pat. No. 4,429,751) discloses a single-acting pneumatic hammer system that uses an array of pneumatic, single-pilot air control valves directly responsive to hammer piston position. The Jackson air control valve system is highly complex, composed of several interacting single-pilot control valves arranged in various series and parallel circuits so that the hammer piston movement can be adjusted. A cushioning material is inserted between the hammer piston and the anvil.

Shortcomings in the post driver field, as typified in these prior art examples, are evident to the skilled artisan and include cumbersome and awkward designs that are generally unreliable, that consume large amounts of air pressure and that operate inefficiently to convert only a portion of the energy stored in the compressed air into downward driving force on a post thus requiring a long time and great quantities of compressed air to drive the post into the earth. The valve-less types of pneumatic drivers are grossly inefficient, whereas the prior art pneumatic drivers operated by external air control valves are woefully delicate for hard use in the field and difficult to repair.

Furthermore, prior art designs include anvils that are not well-suited to high cycle rates. High cycle rates can be especially useful when driving certain post types. It has been found that cycle rates on the order of 180-200 strokes per minute will generate a shock wave through the leading tip of the post to sonically loosen the soil as the post advances into the earth. Anvil designs of the prior art either frustrate operation at high cycle rates or are not constructed so as to withstand the rapid impacts over a reasonable service life.

There is therefore a need in the art for an improved pneumatic type post driver that is reliable, robust, which consumes very little air pressure, operates very efficiently to transfer a maximum amount of energy to a post, and that is capable of sustained use at high cycle rates.

BRIEF SUMMARY OF THE INVENTION

According to a first aspect of this invention, a pneumatic post driving apparatus comprises a housing including an internal cylinder chamber. The cylinder chamber has side walls defining a generally constant internal diameter. A cap encloses a top end of the cylinder chamber. An anvil encloses a bottom end of the cylinder chamber. A hammer piston is disposed in the cylinder chamber for sliding movement between the cap and the anvil. A down-stroke port is disposed in the side wall of the cylinder chamber adjacent the cap. An up-stroke port is disposed in the side wall of the cylinder chamber adjacent the anvil. A first pilot port is disposed in the side wall of the cylinder chamber between the down-stroke port and the up-stroke port. A second pilot port is disposed in the side wall of the cylinder chamber between the first pilot port and the up-stroke port. An air control system is provided for alternately routing pressurized air between the top and bottom ends of the cylinder to move the hammer piston up and down therein. The air control system includes a control valve. The control valve is disposed for movement between first and second working positions in a control body. The control body includes a main air inlet configured for connection to a source of compressed air. A down-stroke passage extends between the control body and the down-stroke port. An up-stroke passage extends between the control body and the up-stroke port. A first pilot passage extends between the first pilot port and the control body for routing a flow of air from the cylinder chamber to urge the control valve away from the first working position and toward the second working position. A second pilot passage extends between the second pilot port and the control body for routing a flow of air from the cylinder chamber to urge the control valve away from the second working position and toward the first working position.

The claimed invention enables a post driving apparatus that can be easily manufactured to provide a reliable apparatus, that consume small amounts of air pressure and operates efficiently to convert a significant portion of the energy stored in the compressed air into downward driving force on a post. The claims control valve is robust enough to withstand hard use in the field and can be easily repaired by the ordinary user.

According to a second aspect of this invention the pneumatic post driving apparatus, the anvil includes an annular retention flange that has a conically tapered under surface. A lower elastomeric pad is disposed between the housing and the tapered under surface of the retention flange. The lower elastomeric pad has a tapered engagement surface that complements the tapered under surface of the retention flange so that the two surfaces meet in direct surface-to-surface contact. This unique anvil design is particularly suited to operation at high cycle rates and is able to withstand rapid impacts over an extended service life without failure.

The claimed invention thus provides an improved pneumatic type post driver that is reliable, robust, which consumes very little air pressure, operates very efficiently to transfer a maximum amount of energy to a post as it is driven into the earth, and that is capable of sustained use at high cycle rates.

BRIEF DESCRIPTION OF THE SEVERAL VIEWS OF THE DRAWINGS

These and other features and advantages of the present invention will become more readily appreciated when considered in connection with the following detailed description and appended drawings, wherein:

FIG. 2 depicts a typical prior art metal post of the type driven into the earth and subsequently used to support strands or mesh of wire fencing, guy wires, and the like;

DETAILED DESCRIPTION OF THE INVENTION

Figure 1:
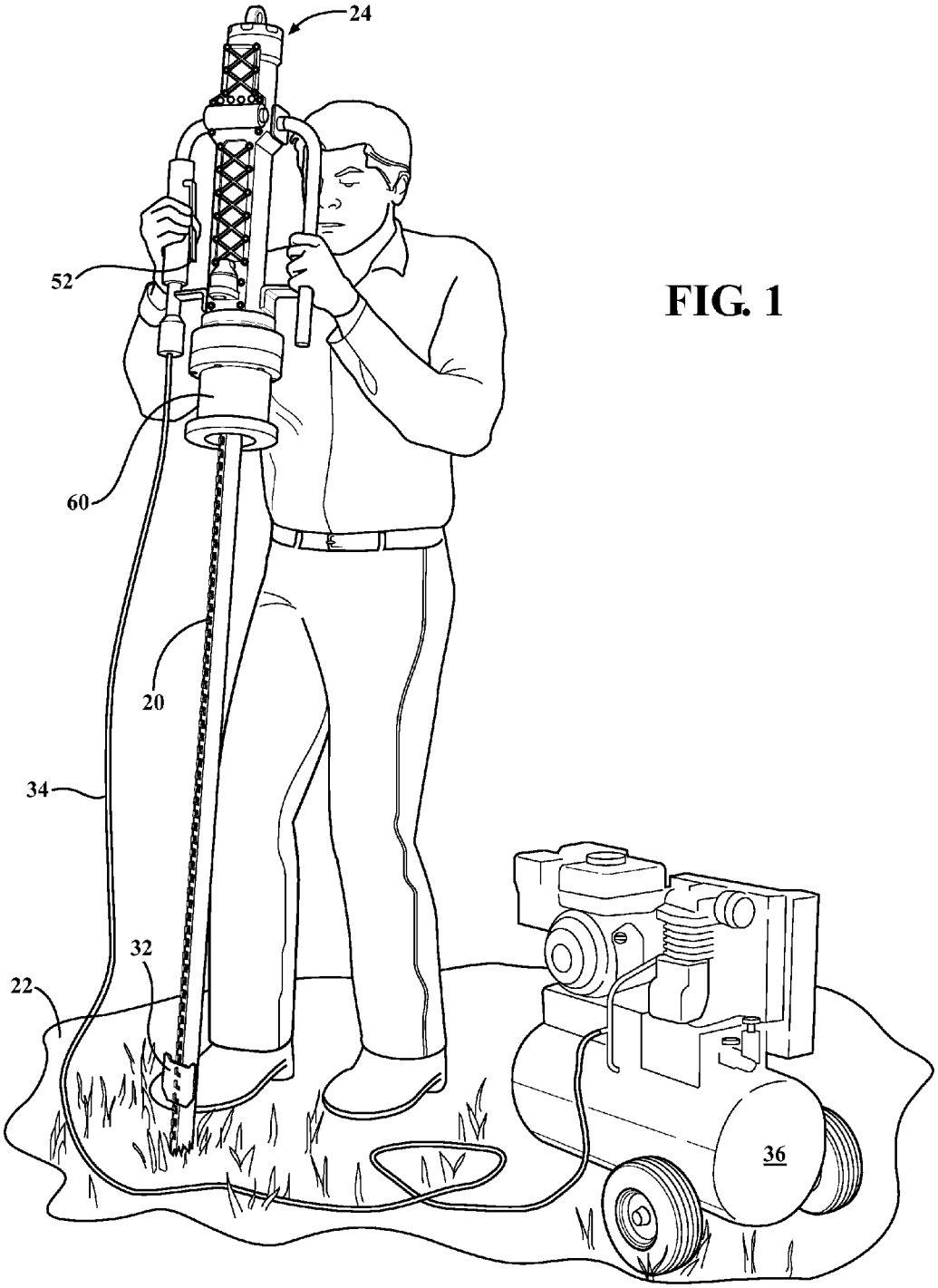
FIG. 1 is an environmental view showing the apparatus of the present invention in one contemplated useful application.
Figure 2:
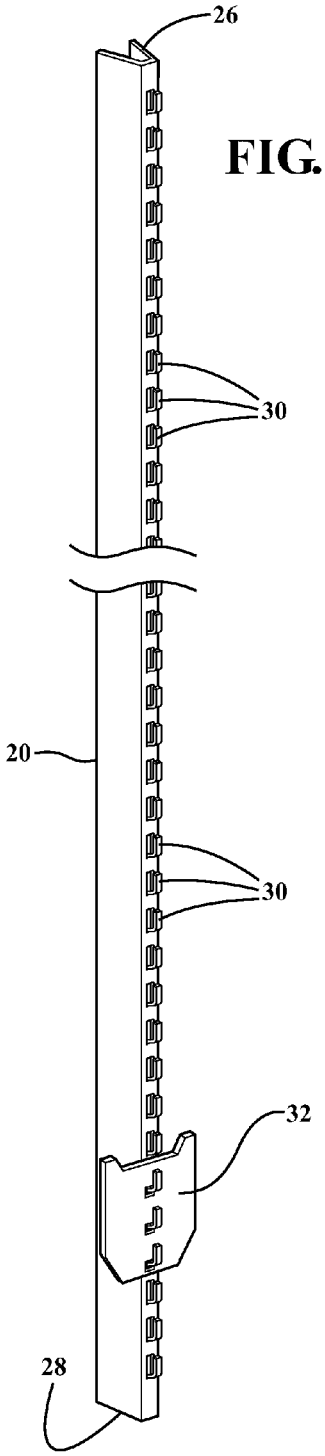
Figure 3:
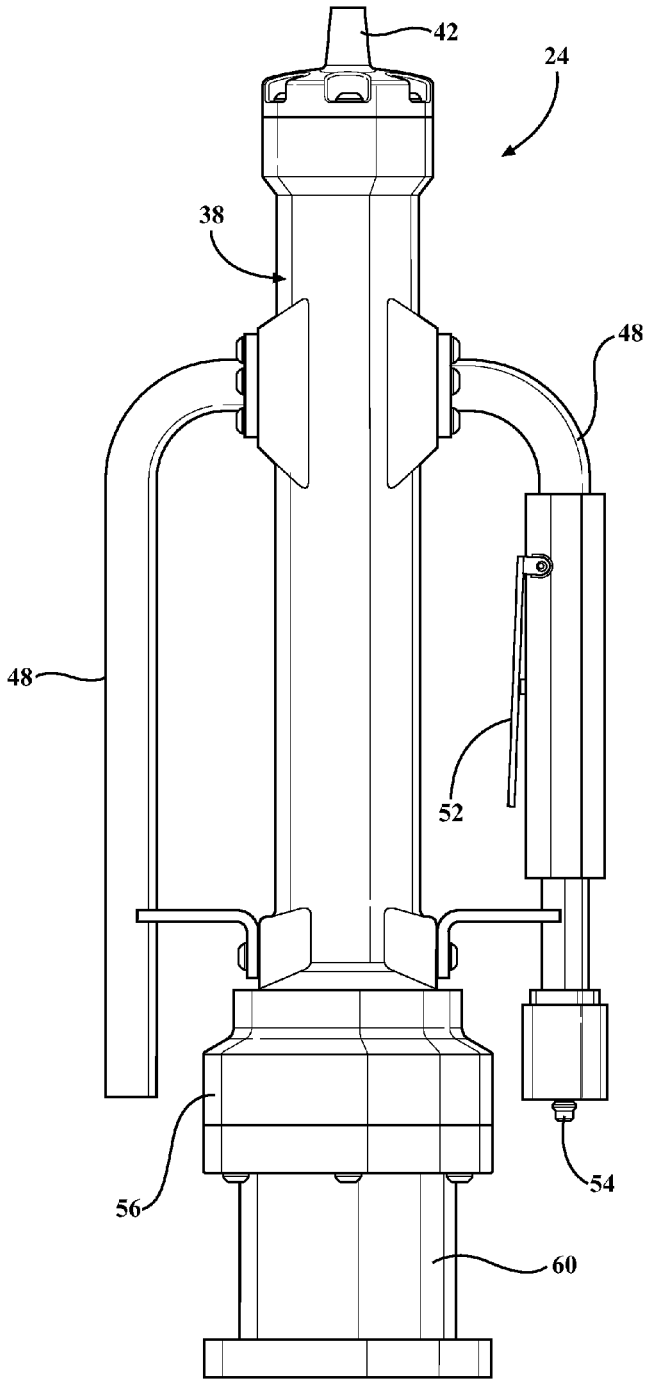
FIG. 3 is a rear operator's view of the apparatus of the present invention according to one contemplated embodiment.
Figure 4:
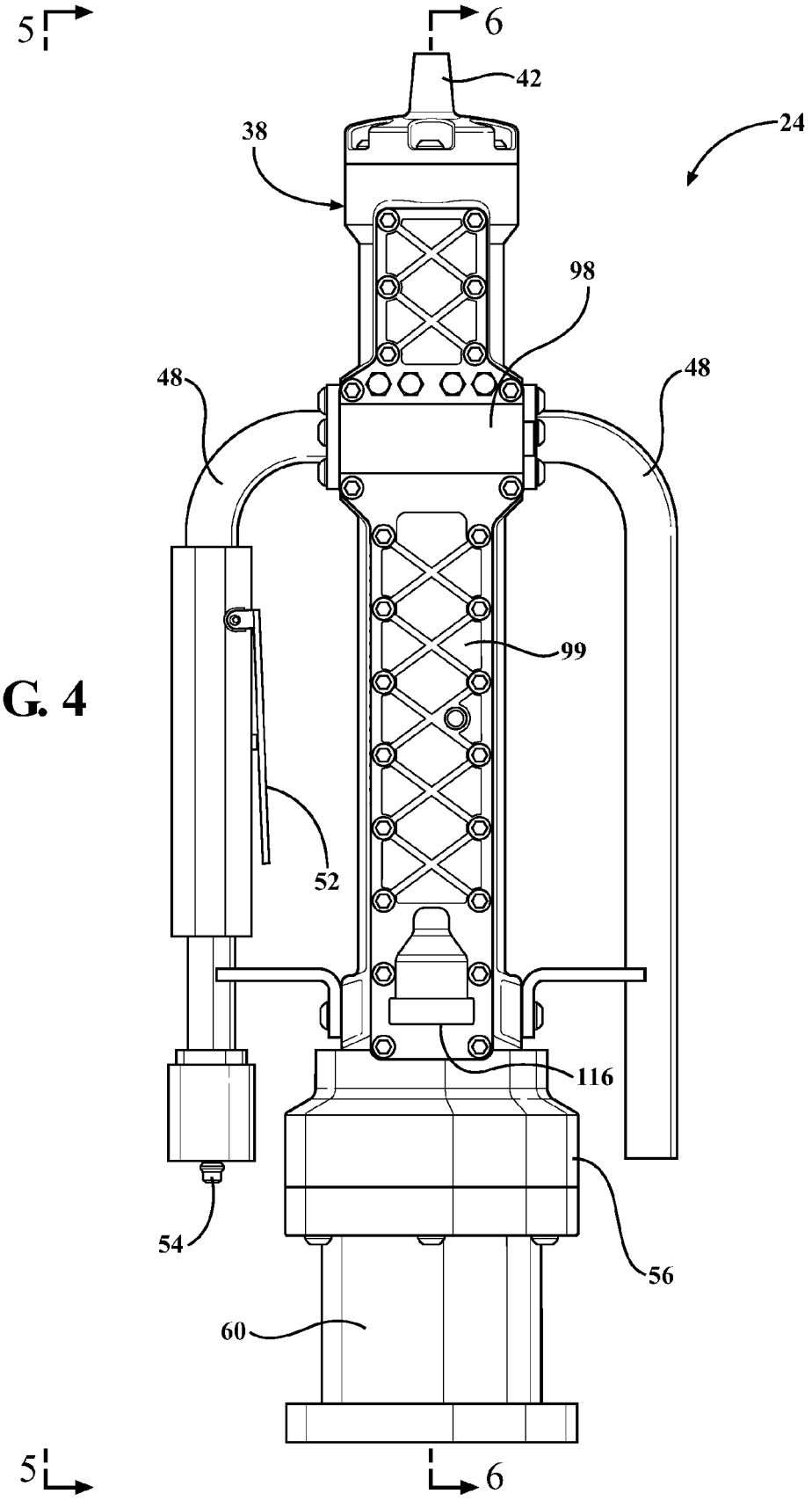
FIG. 4 is a front view of the apparatus of the present invention.
Figure 5:
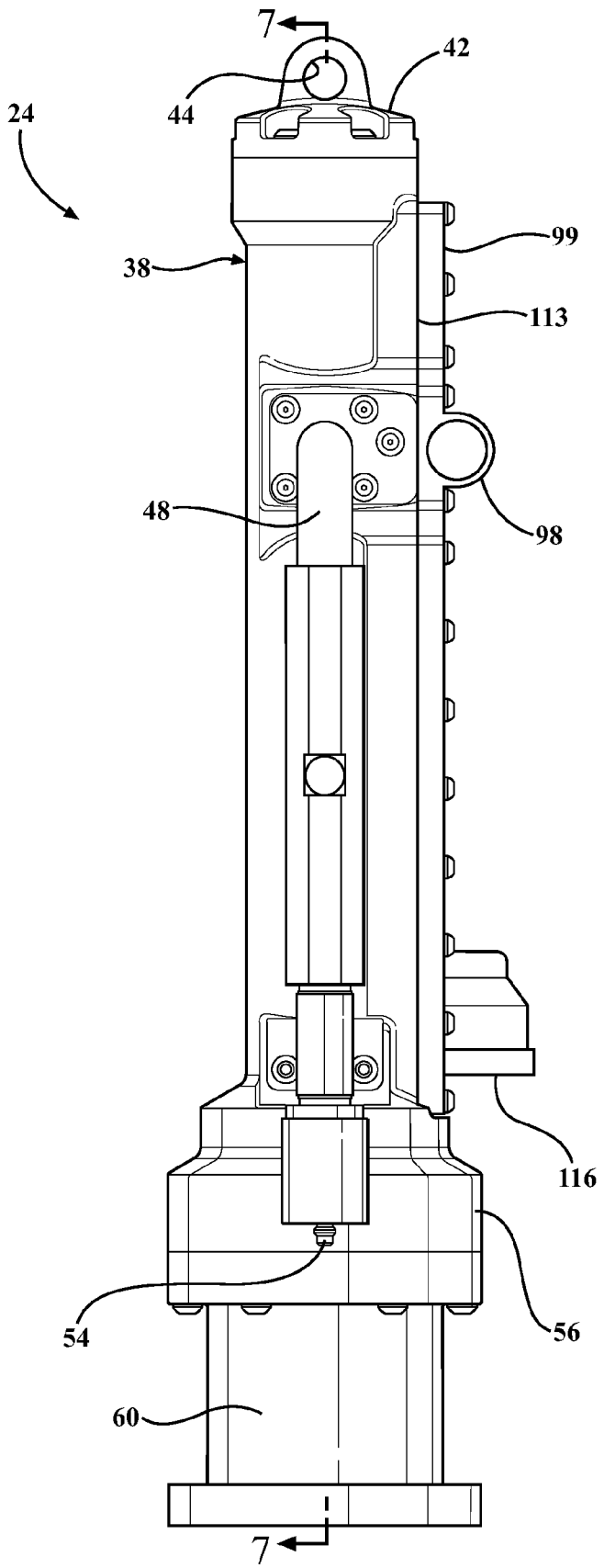
FIG. 5 is a left side view as taken generally along lines 5-5 in FIG. 4.

Referring to the figures, wherein like numerals indicate like or corresponding parts throughout the several views, FIG. 1 shows an ordinary user driving a post 20 into the earth 22 using a post driving apparatus 24 according to one embodiment of the present invention. One exemplary form of a post 20 is shown in greater detail in FIG. 2 having an upper end 26 and bottom or leading end 28. In this particular example, the post 20 is provided with the common studs or nubs 30 along the spine that prevent the fence wire or mesh (not shown) from sliding up or down the post 20. The post 20 may further include a flat plate 32 for improved stabilization when buried into the soil. The apparatus 24 is connected via an air hose 34 to a source of compressed air in the exemplary form here of a portable air compressor 36. Of course, the specific type of post 20 as shown in FIGS. 1 and 2, and the specific type of compressed air source, are merely exemplary; any type of suitable post may be driven with the apparatus 24 and any type of suitable air source may be used.

Turning now to FIGS. 3-7, the pneumatic post driving apparatus 24 is shown including a housing 38. The housing 38 encloses an internal cylinder chamber 40, perhaps best shown in FIGS. 6 and 7. The cylinder chamber 40 has circumferential internal side walls defining a generally constant internal diameter. A cap 42 encloses a top end of the cylinder chamber 40. The cap 42 is shown in this example fastened to the top of the housing 38 and formed with a hole 44 to receive a hook (not shown) for high-reach suspended applications. The cap 42 may be optionally formed with an internal pocket 46. As will be described subsequently, the pocket 46 can be included in applications where additional braking is required to arrest the up-stroke of the hammer piston.

At least one, and preferable a pair, of handles 48 are attached to or otherwise formed on the exterior of the housing 38. The handles 48 are shown clearly in FIGS. 3 and 4, being arranged on opposing sides of the housing 38. One of the handles 48 includes an internal air conduit 50, as shown in the cross-sectional view of FIG. 7. A manually operated flow control valve 52 is operatively associated with the internal air conduit 50 for selectively permitting the flow of air through the internal air conduit 50. The flow control valve 52 is shown in the Figures as a typical normally-closed paddle or spring-lever type device. Those of skill in the art will appreciate that other forms of manually actuated valves are certainly possible, such as a rotary cam-type valve. Preferably, the flow control valve 52 is configured with a "lock-on" feature that allows the operator to remove their hand from one or both handles 38 without interrupting the flow of air through the internal air conduit 50. This feature may be especially helpful with the apparatus 24 is suspended from the hole 44 in the cap 42 during high-reach applications. A quick-connect coupling 54 is disposed on a distal end of the one handle supporting the internal air conduit 50 for connecting to the air hose 34. Thus, air is admitted from the compressed air source 36 to the internal air conduit 50 via the air hose 34 connected to the coupling 54.

The housing 38 includes a driver base 56. The driver base 56 establishes the bottom of the housing in the exemplary design illustrated in the Figures. As perhaps best shown in the enlarged view of FIG. 13, the driver base 56 comprises a widened section that is internally threaded. A retainer ring 58 is threadably disposed within the driver base 56. A generally cylindrical guide tube 60 is affixed to the driver base 56 with fasteners or by other convenient fitting type, and extends downwardly from the driver base 56 a short distance until terminating at an open bottom. The guide tube 60 is configured like a skirt to encircle the upper end 26 of a post 20 to be driven. The guide tube 60 can be made in different sizes to accommodate different size/shape posts 20.

Figure 6:
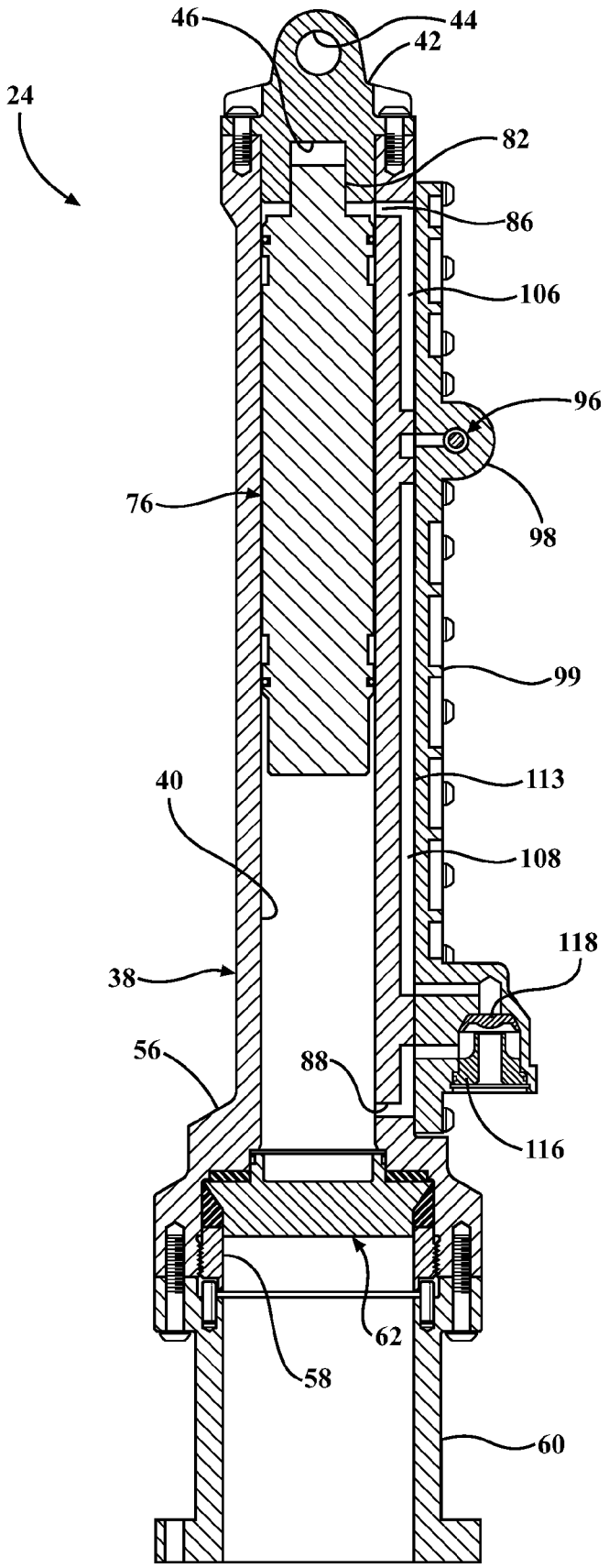
FIG. 6 is a cross-sectional view as taken generally along lines 6-6 in FIG. 4.
Figure 7:
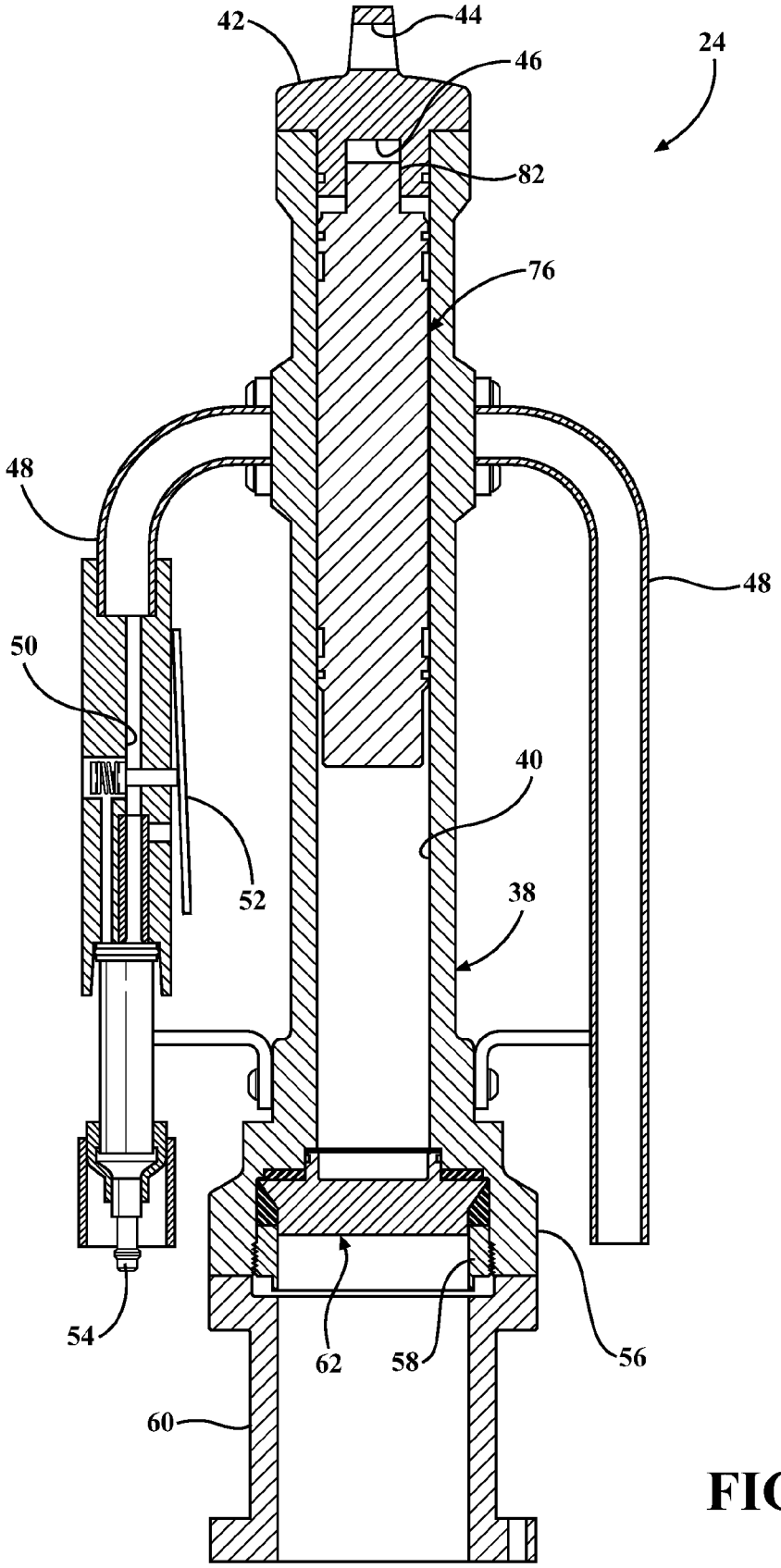
FIG. 7 is a cross-sectional view as taken generally along lines 7-7 in FIG. 5.
Figure 14:
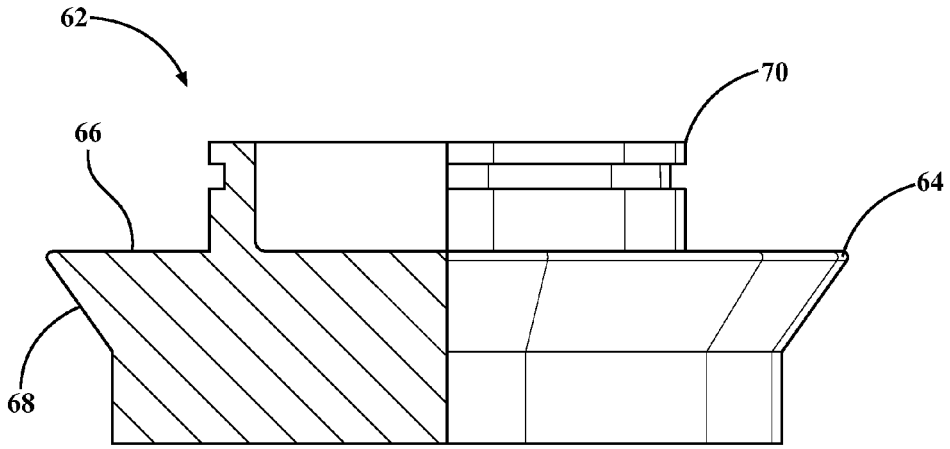
FIG. 14 is a quarter-section of the anvil.
Figure 13:
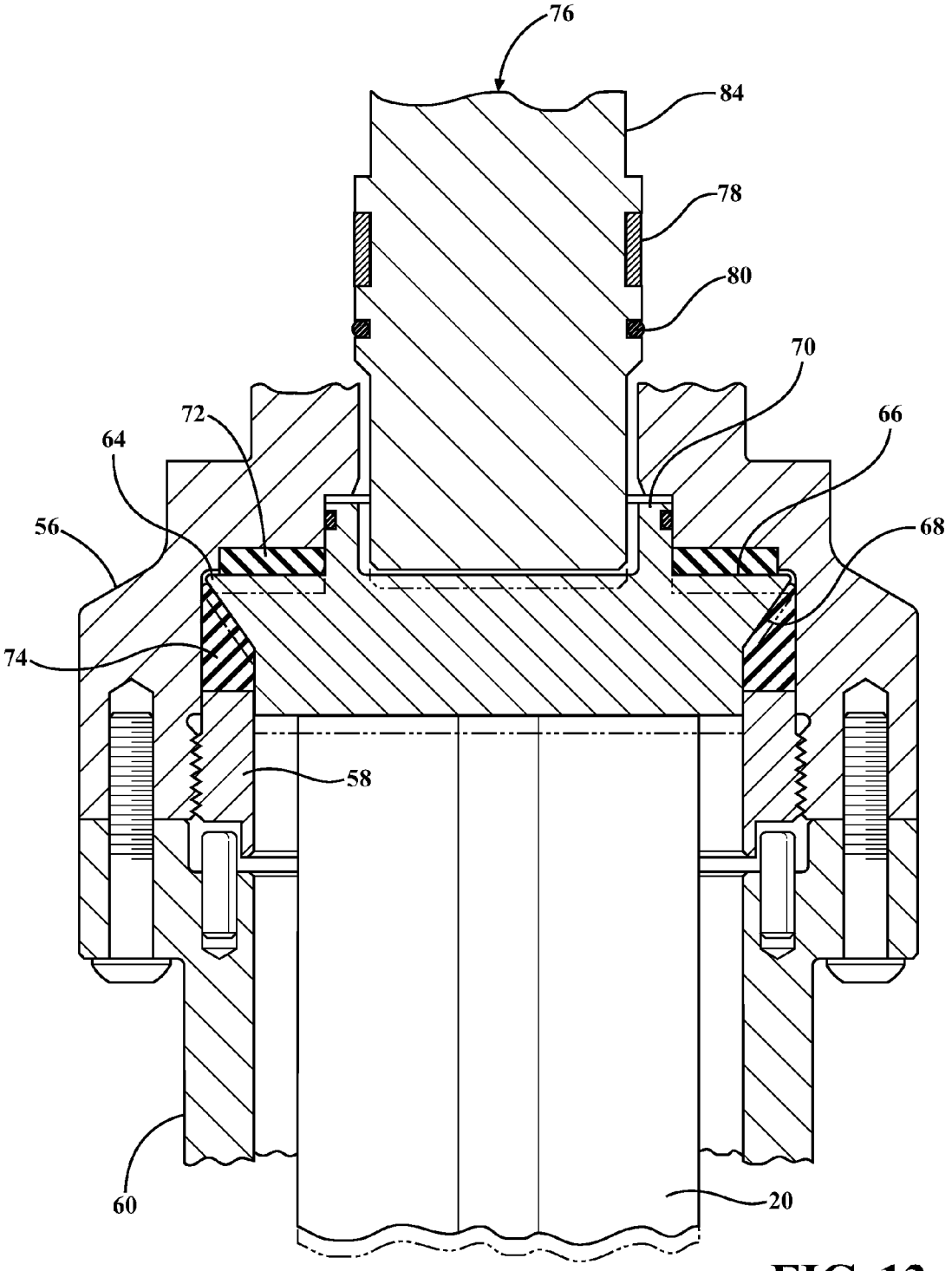
FIG. 13 is a fragmentary cross-section of the housing/guide tube interface highlighting the anvil and its elastomeric support details according to one contemplated embodiment.

Returning now to the cross-sectional views of FIGS. 6, 7 and 13, an anvil 62 is shown disposed within the driver base 56. The anvil 62 encloses a bottom end of the cylinder chamber 40. That is, the cylinder chamber 40 is stopped at opposite top and bottom ends by the cap 42 and anvil 62, respectively. The anvil 62 in this embodiment is formed as a body of revolution, and is fabricated preferably from a tough and solid metallic material such as steel. The quarter-sectional view of FIG. 14 provides a simultaneous internal-external view of the anvil 62 according to one exemplary embodiment of the invention. In this particular embodiment, which is designed to operate at high cycle rates and to withstand rapid impacts over an extended service life, the anvil 62 has an annular retention flange 64 serving as the primary feature by which the anvil 62 is supported in the housing 38. The retention flange 64 has a generally perpendicular upper surface 66 and a conically tapered under surface 68. The taper angle of the under surface 68 is preferably in the range of about 30-60 degrees (measured from an imaginary central vertical axis), however taper angles outside this range may be possible under some circumstances. The generally flat base of the anvil 62 is configured to be rested directly on top of a post 20 as shown in FIG. 13. Additional features of the anvil 62 include a circular rim 70 extending upwardly from the upper surface of the retention flange 64. The circular rim 70, therefore, is situated opposite the flat base and opposite a post 20 in use. The outer diameter of the circular rim 70 is adapted to seat with a trim sliding fit in a counter-bore formed inside the driver base 56 end of the housing 38. An O-ring may be disposed in an external groove cut into the outer surface of the circular rim 70 to establish a generally air-tight interface with the counter-bore inside the driver base 56, as perhaps best shown in FIG. 13. An inner diameter of the circular rim 70 is dimensioned to be generally equal to the internal diameter of the cylinder chamber 40, thus providing a somewhat continuous extension of the cylinder chamber 40 a short distance into the anvil 62.

The anvil 62 is resiliently suspended inside the driver base 56 of the housing 38 by an upper elastomeric pad 72 and a lower elastomeric pad 74. The upper elastomeric pad 72 is disposed between the housing 38 and the upper surface of the retention flange 64, and the illustrated embodiment has a flat annular shape like a thick washer. The lower elastomeric pad 74 is disposed between the housing 38 and the tapered under surface 68 of the retention flange 64. Still referring to FIG. 13, the lower elastomeric pad 74 is shown having a tapered engagement surface that complements the tapered under surface 68 of the retention flange 64 so that the two opposing surfaces meet in direct surface-to-surface contact. The retainer ring 58 of the housing 38 is disposed below the lower elastomeric pad 78 so as to hold it in compression against the retention flange 64. The degree of compression, or pre-load, can be controlled by the degree to which the threaded retainer ring 58 is twisted into the mating threads of the driver base 56.

In this manner, the anvil 64 is suspended in position at the base of the cylinder chamber 40 with shock-absorbing upper 72 and lower 74 elastomeric pads. The tapered interface between the tapered under surface 68 of the retention flange 64 and the lower elastomeric pad 74 is designed to generate an outwardly and downwardly fanning stress response each time the anvil 62 is struck. This outwardly and downwardly fanning stress response places the lower elastomeric pad 74 in a state of almost complete compression as it is pushed into the annular corner formed between the top of the retainer ring 58 and the inside of the driver base 56. Such intentional control and manipulation of the stress response via the tapered interface enables the anvil 62 to operate at high cycle rates, e.g., on the order of a steady 180-200 impacts per minute, over an extended service life without failure. The upper elastomeric pad 72 serves mainly to control recoil of the anvil 62 after each impact. That is, as the lower elastomeric pad 74 responds to maximum compression following an impact event, the upper elastomeric pad 72 expands or swells slightly (via its pre-load installation condition) to maintain a light backing pressure on the upper surface 66 of the retention flange 64. As the lower elastomeric pad 74 returns to its original shape, the upper elastomeric pad 72 keeps the anvil 62 resiliently suspended and prevents metal-to-metal contact between anvil 62 and housing 38. Furthermore, with each impact on the anvil 62 and its slight axial displacement enabled by the resilient lower elastomeric pad 74, the O-ring interface between the circular rim 70 of the anvil 62 and the counter-bore of the driver base 56 maintains a dynamic air-tight seal for the cylinder chamber 40.

Returning again to FIGS. 6 and 7, a hammer piston is general indicated at 76. The hammer piston 76 is disposed in the cylinder chamber 40 for sliding movement between the cap 42 and the anvil 62. The hammer piston 76 may be configured in any number of shapes and manner to achieve a low-friction sliding interface within the cylinder chamber 40. In the illustrated embodiment, the hammer piston is depicted as a solid metallic body of revolution. A pair of sliding bearings 78 are provided at opposite ends to reduce friction and wear against the side walls of the cylinder chamber 40. Similarly, a pair of piston rings 80 positioned outside the respective bearings 78 establish a substantially air-tight dynamic interface. The bottom of the hammer piston 76 comprises a nose that is configured to forcefully strike the anvil 62 with each down-stroke. More specifically, the nose of the hammer piston 76 strikes the anvil 62 within the circular confines of its rim 70. A nipple 82 may optionally be formed at the top end of the hammer piston 76. When the cap 42 is provided with a pocket 46, the hammer piston 76 may include the nipple 82 which is then configured to slide into the pocket 46 as the hammer piston 76 nears its full up-stroke position. Air trapped in the pocket 46 is compressed by the ascending nipple 82 and acts as an air spring to decelerate and slow the hammer piston 76 and help accelerate its reversal in the down-stroke direction. The hammer piston 76 also preferably includes a reduced diameter central region 84 for reasons to be described subsequently. The reduced diameter central region 84 may extend for the majority of the intervening length of the hammer piston 76 between the bearings 78.

Figure 8:
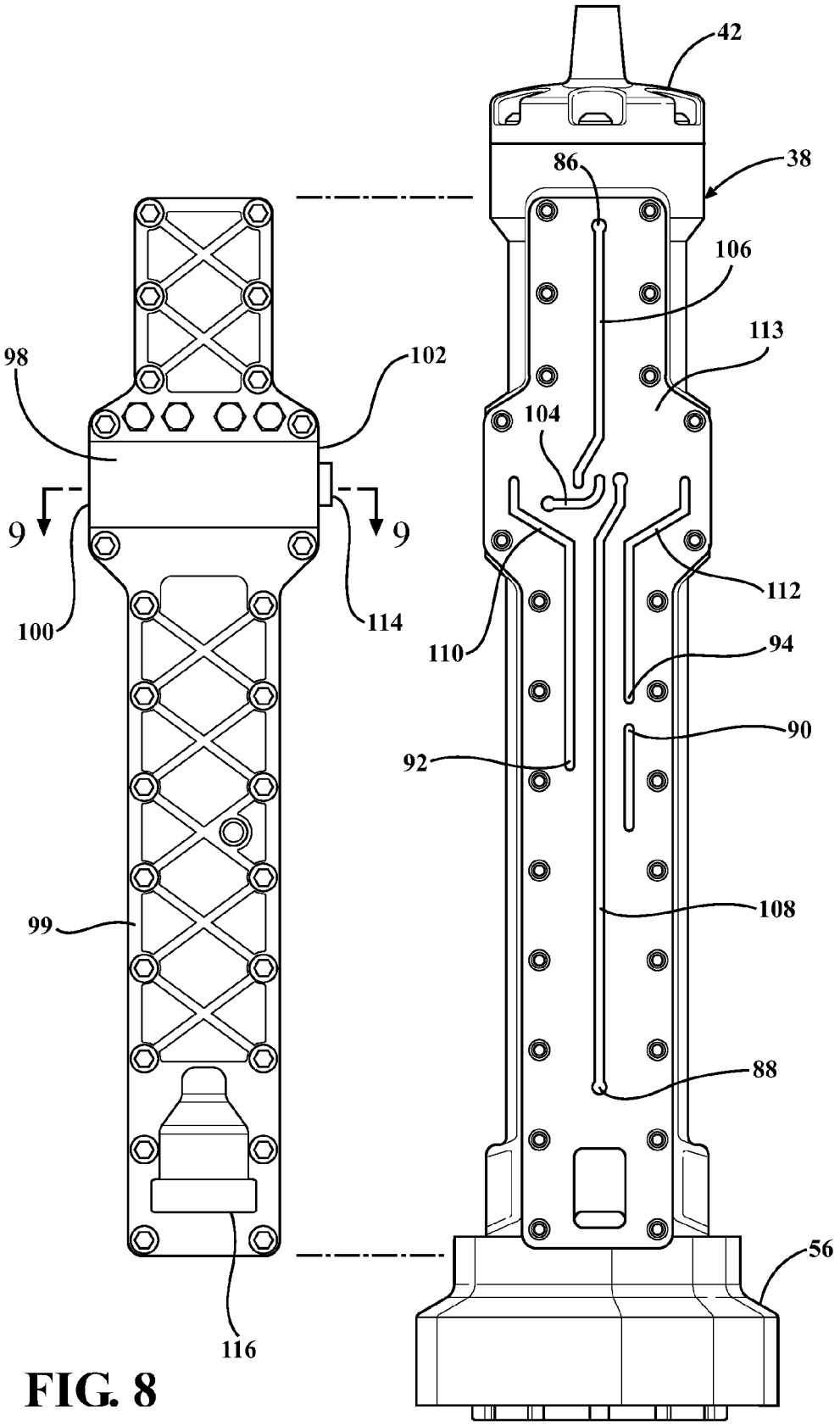
FIG. 8 is an exploded view of the housing and manifold cover according to one contemplated embodiment.
Figure 11A:
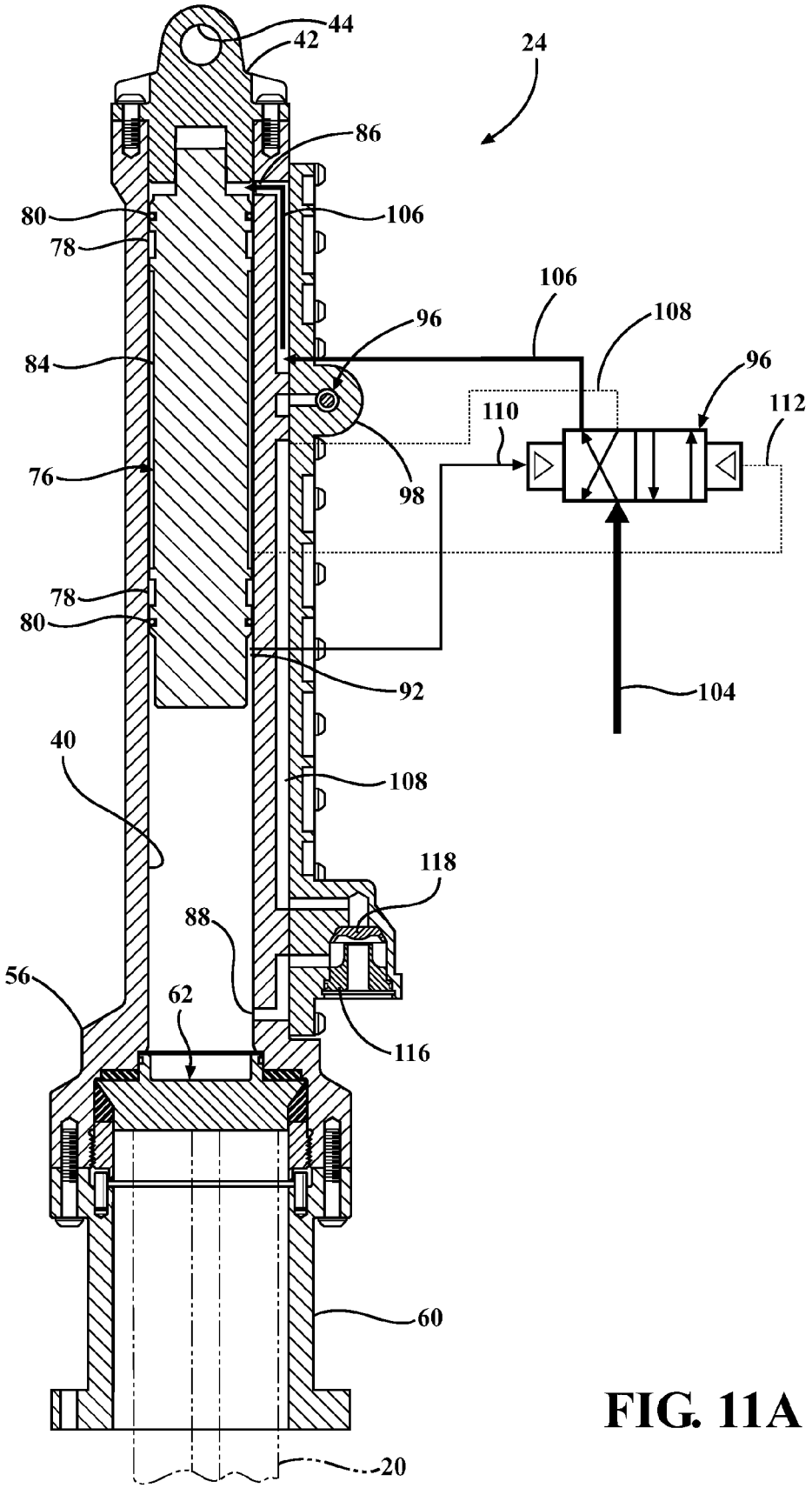
FIG. 11A-11E are sequential, cross-sectional views depicting movement of the hammer piston though one complete down-up cycle within the cylinder chamber and corresponding air flow movements through the control valve and various passages.

In FIGS. 6 and 8, a down-stroke port 86 is shown disposed in the side wall of the cylinder chamber 40 adjacent the cap 42. An up-stroke port 88 disposed in the side wall of the cylinder chamber 40 adjacent the anvil 62. Air admitted to the cylinder chamber 40 through the down-stroke port 86 will enter above the hammer piston 76 and force the hammer piston 76 to travel in a down-stroke direction toward the anvil 62. Conversely, air admitted to the cylinder chamber 40 through the up-stroke port 88 will enter below the hammer piston 76 and force the hammer piston 76 to travel in an up-stroke direction toward the cap 42. Additional ports into the cylinder chamber 40 are better discerned from FIGS. 11A-11E and include a pilot depressurization port 90 (FIG. 8), a first pilot port 92 and a second pilot port 94. The pilot depressurization port 90 extends to atmosphere from the cylinder chamber 40 from a mid-point position longitudinally between the down-stroke port 86 and the up-stroke port 88. The first pilot port 92 is disposed in the side wall of the cylinder chamber 40 between the up-stroke port 88 and the pilot depressurization port 90, and preferably proximate the pilot depressurization port 90 so that it is exposed to air flow when the hammer piston 76 reaches is full up-stroke (FIGS. 11A, 11E). The second pilot port 94 is disposed in the side wall of the cylinder chamber 40 between the down-stroke port 86 and the pilot depressurization port 90, and preferably proximate the pilot depressurization port 90 so that it is exposed to air flow when the hammer piston 76 reaches is full down-stroke (FIG. 11C).

Figure 9:
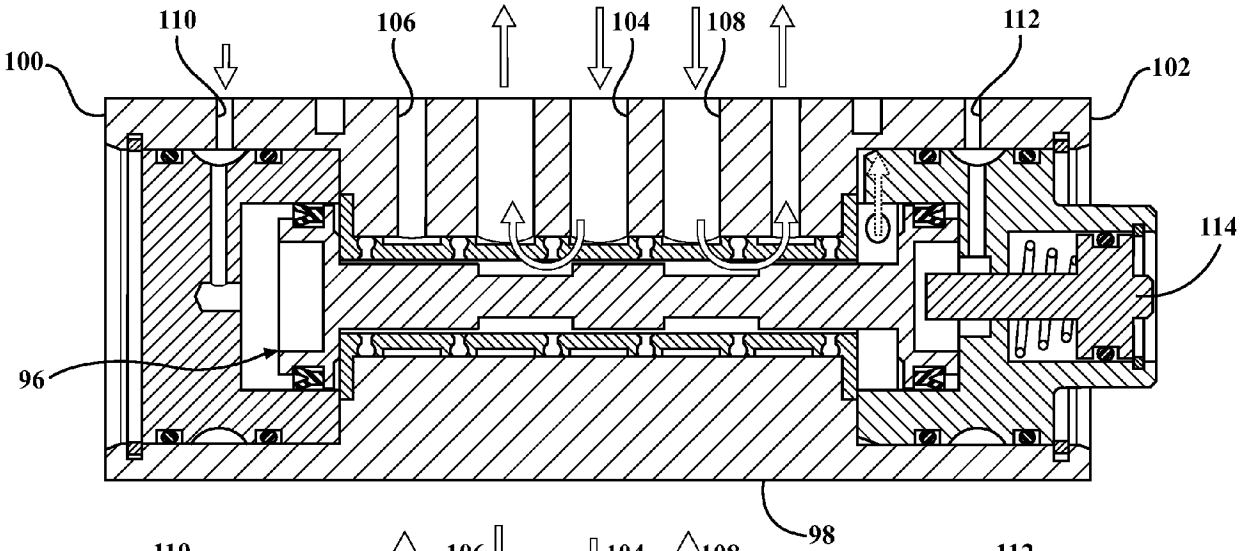
FIG. 9 is a cross-sectional view of the control body as taken generally along lines 9-9 in FIG. 8, and showing the control valve therein in a second working position.
Figure 10:
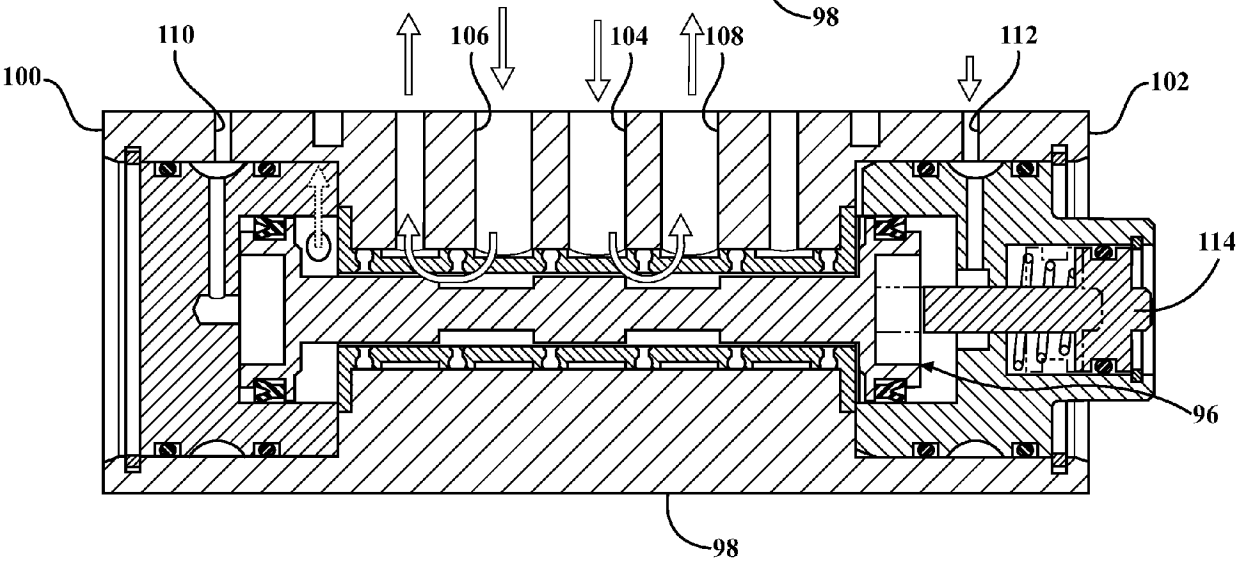
FIG. 10 is a cross-sectional view as in FIG. 9, showing the control valve in a first working position.

An air control system is provided for alternately routing pressurized air between the top and bottom ends of the cylinder chamber 40 to move the hammer piston 76 up and down therein. The air control system of the present invention is efficient and robust and easily maintained by the ordinary user. The air control system includes a control valve, generally indicated at 96 in FIGS. 9 and 10. The control valve 96 is preferably of the spool valve type and disposed for linear reciprocating movement within a control body 98. The control body may be formed integrally with a manifold cover plate 99 as shown in FIGS. 6 and 8. FIGS. 9 and 10 are enlarged views that shown the control body 98 having first 100 and second 102 ends. In the illustrated views, the first end 100 of the control body 98 corresponds to the left-hand side, and the second end 102 corresponds to the right hand side. Of course, these sides can be switched or alternatively the control valve 96 can be oriented differently (e.g., vertically) or can be formed as a rotary-type spool valve instead of a sliding type. Those of skill in the art recognize that many alternative configurations of the control valve 96 are possible without departing from the spirit of this invention.

In the embodiment depicted in the drawings, the control valve 96 is a sliding-type spool valve cylindrical in cross section, and having a series of lands and grooves formed along its length. The lands selectively block and permit air flow through the control body 98. In this embodiment, the control valve 96 is configured with two fundamental positions: a first working position and a second working position. The first working position is illustrated in FIG. 10 and is defined by the control valve 96 moved as far as possible toward the first (left) end 100 of the control body 98. The second working position is illustrated in FIG. 9 where the control valve 96 located as far as possible toward the second (right) end 102 of the control body 98. As will be described below, when the control valve 96 is in the first working position (FIG. 10), air is directed to the up-stroke port 88 and causes the hammer piston 76 to travel in an up-stroke direction. Conversely, when the control valve 96 is in the second working position (FIG. 9), air is directed to the down-stroke port 86 and causes the hammer piston 76 to travel in a down-stroke direction. Alternative constructions of the control valve will of course result in different air flow configurations which nevertheless result in similar operation of the apparatus 24.

Referring primarily to FIGS. 8-10, the control body 98 is networked with a plurality of air flow passages. These air flow passages include a main air inlet 104 configured for connection to the source of compressed air 36. In the preferred embodiment, the main air inlet 104 is directly connected to the internal air conduit 50 in the one handle 48 so that whenever the flow control valve 52 is actuated compressed air rushes into the control body 98. A down-stroke passage 106 extends between the control valve 96 and the down-stroke port 86. An up-stroke passage 108 extends between the control valve 96 and the up-stroke port 88. A first pilot passage 110 extends between the first pilot port 92 and the control body 98 for routing a flow of air from the cylinder chamber 40 to urge the control valve 96 away from its first working position and toward its second working position. A second pilot passage 112 extends between the second pilot port 94 and the control body 98 for routing a flow of air from the cylinder chamber 40 to urge the control valve 96 away from its second working position and toward its first working position. That is, when air flows through the first pilot passage 110 the control valve 96 is pushed toward the second (right) end 102 of the control body 98. And conversely, when air flows through the second pilot passage 112 the control valve 96 is pushed toward the first (left) end 100 of the control body 98. In the preferred embodiment, these air flow passages 104-112 are formed in a manifold 113, which may be an integral part of the housing 38. The passages 104-112 are cut as grooves in the manifold 113, and covered with the manifold cover plate 99 which may be gasketed to perfect a seal.

A reset button 114 may be provided to manually urge the control valve 96 toward one of the first 100 and second 102 ends of the control body 98. As shown by phantom lines in FIG. 10, the reset button 114 may advantageous be located on the second end 102 of the control body 98 so that a user can push the control valve 96 toward the first working position. The reset button 114 is useful when, at start-up, the control valve 96 is inadvertently located mid-way between the first and second working positions. In this case, the hammer piston 76 may not properly begin cycling. By resetting the control valve 96 to the first working position, air will be directed to lift the hammer piston 76 in an up-stroke direction, from which normal cyclic operation will commence.

Referring now to FIGS. 11A-11E, one complete up-down cycle of the hammer piston 76 will be described. In FIG. 11A, the hammer piston 76 is shown in a full up (top dead center) position. The control valve 96 is in the second working position (FIG. 9), a result of the hammer piston 76 being in a full up position so that the second pilot port 94 is exposed allowing compressed air from below the hammer piston 76 to flow through the first pilot passage 110. Air entering the control body 98 via the main air inlet 104 is directed into the down-stroke passage 106 and into the top of the cylinder chamber 40 via the down stroke port 86.

Figure 11B:
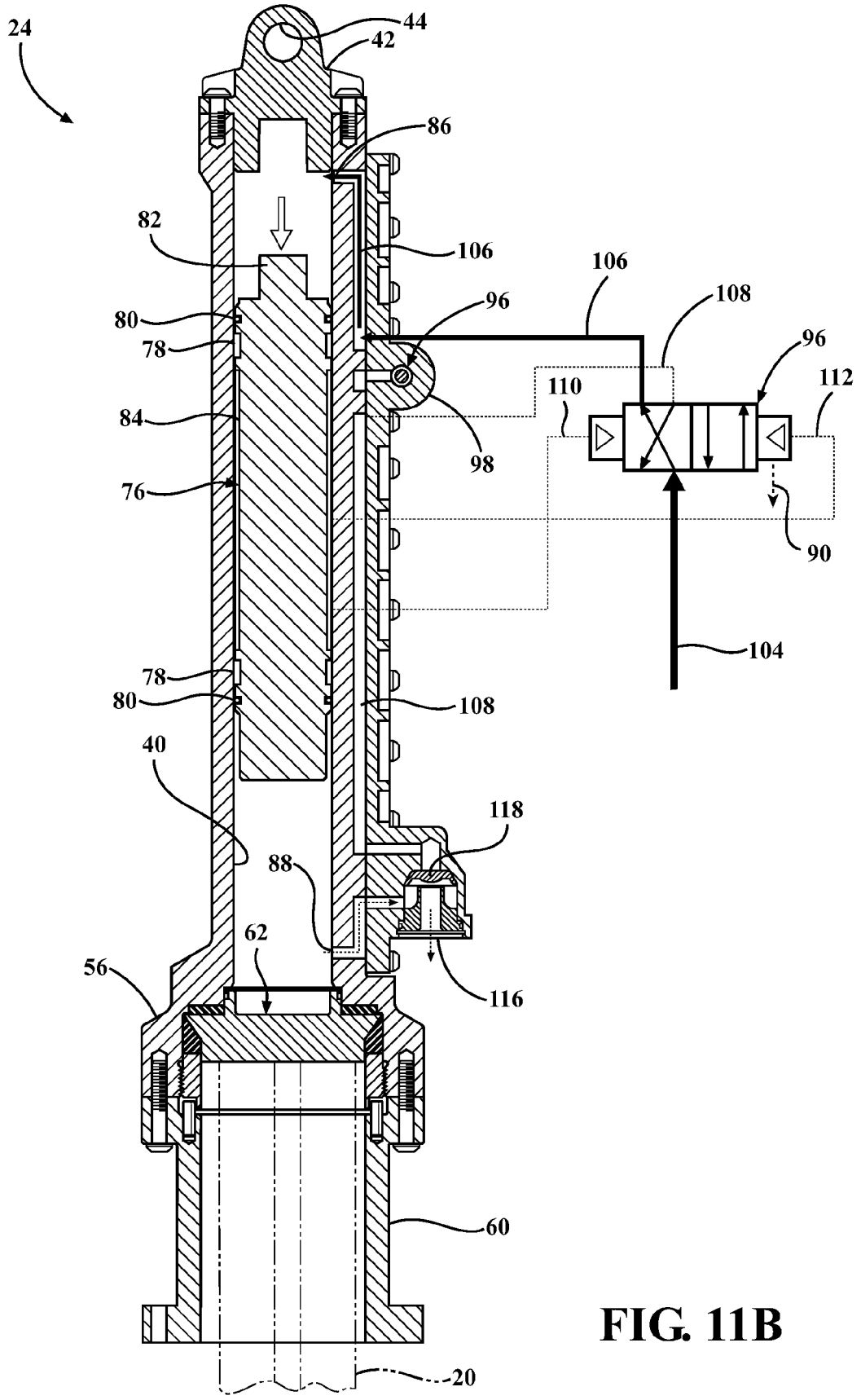
Figure 11C:
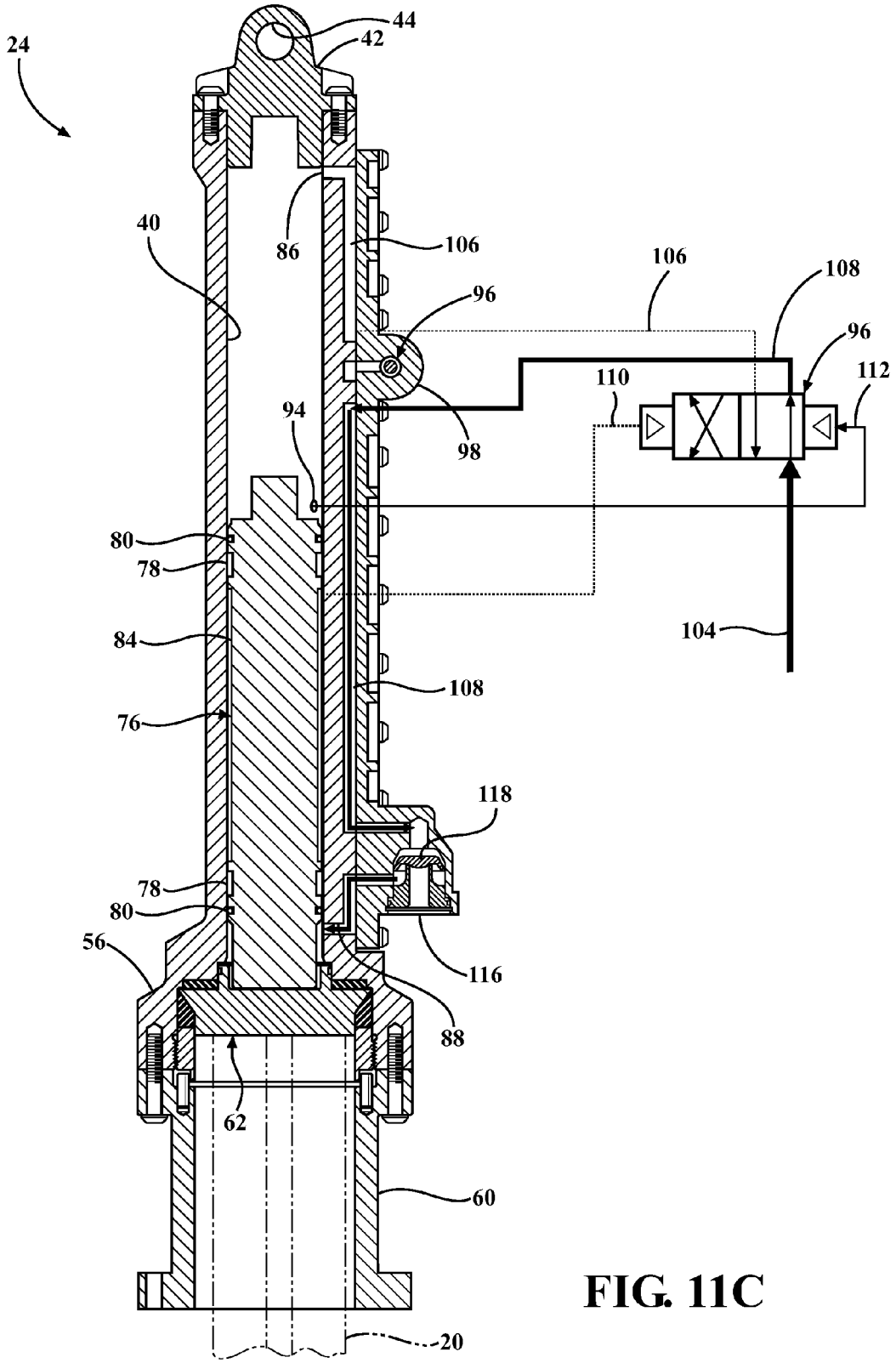

In FIG. 11B, the hammer piston 76 is in down-stroke under the combined forces of gravity and compressed air filling the cylinder chamber 40 through down-stroke port 86. The control valve 96 remains in the second working position. Air entering the control body 98 via the main air inlet 104 is directed into the down-stroke passage 106 and into the top of the cylinder chamber 40 via the down stroke port 86. The reduced diameter central region 84 of the hammer piston 76 concurrently exposes both pilot depressurization port 90 and the first 92 and second 94 pilot ports to external atmosphere, thus effectively depressurizing both ends 100, 102 of the control valve 96. In other words, when the pilot ports 92, 94 are able to communicate with the pilot depressurization port 90 via the reduced diameter central region 84 of the hammer piston 76, all pressure exerted on either end of the control valve 96 is released so that the control valve 96 is ready for instantaneous movement at a future moment in the operating cycle. As the piston descends through its down-stroke, air below the hammer piston 76 is expelled though the up-stroke port 88. In order to facilitate rapid air discharge so that the hammer piston 76 can descend rapidly, a dump valve 116 is located along the up-stroke passage 108. A one-way valve 118 prevents the rapidly exhausting air from the cylinder chamber 40 from moving back toward the control valve 96. The rapid exhaust of air on the down-stroke accelerates the hammer piston 76 down unimpeded about twice as fast as the up-stoke, or at about a 2:1 ratio.

In FIG. 11C, the hammer piston 76 is shown in a full down (bottom dead center) position, having forcefully struck the anvil 62. Because the hammer piston 76 is in a full down position, the first pilot port 92 is exposed allowing compressed air from above the hammer piston 76 to urge the control valve 96 toward the first working position (FIG. 10). Air entering the control body 98 via the main air inlet 104 is directed into the up-stroke passage 108 and into the bottom of the cylinder chamber 40 via the up-stroke port 88. Air flow moving through the up-stroke passage 108 causes the one-way valve 118 to bypass the dump valve 116.

Figure 11D:
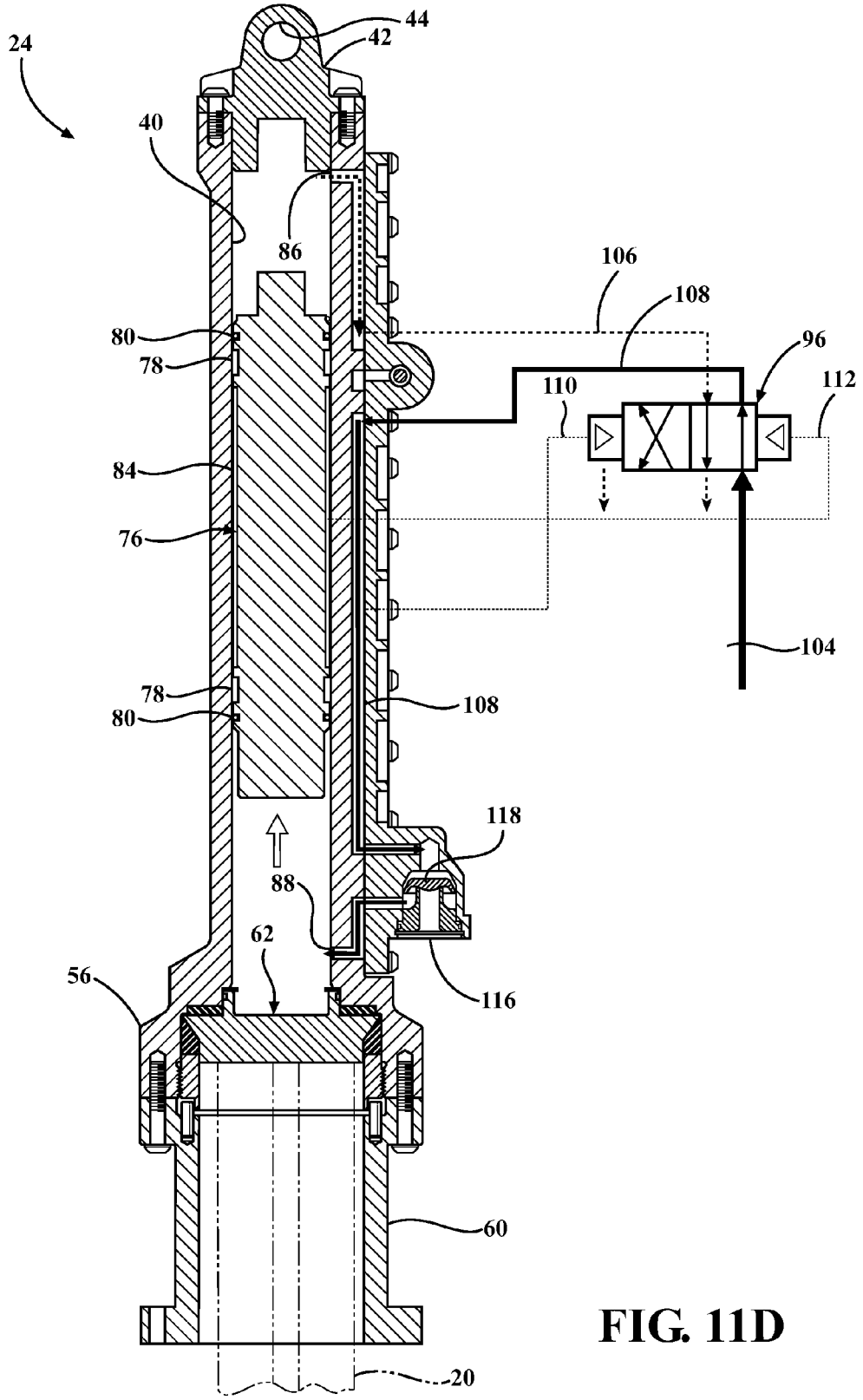
Figure 11E:
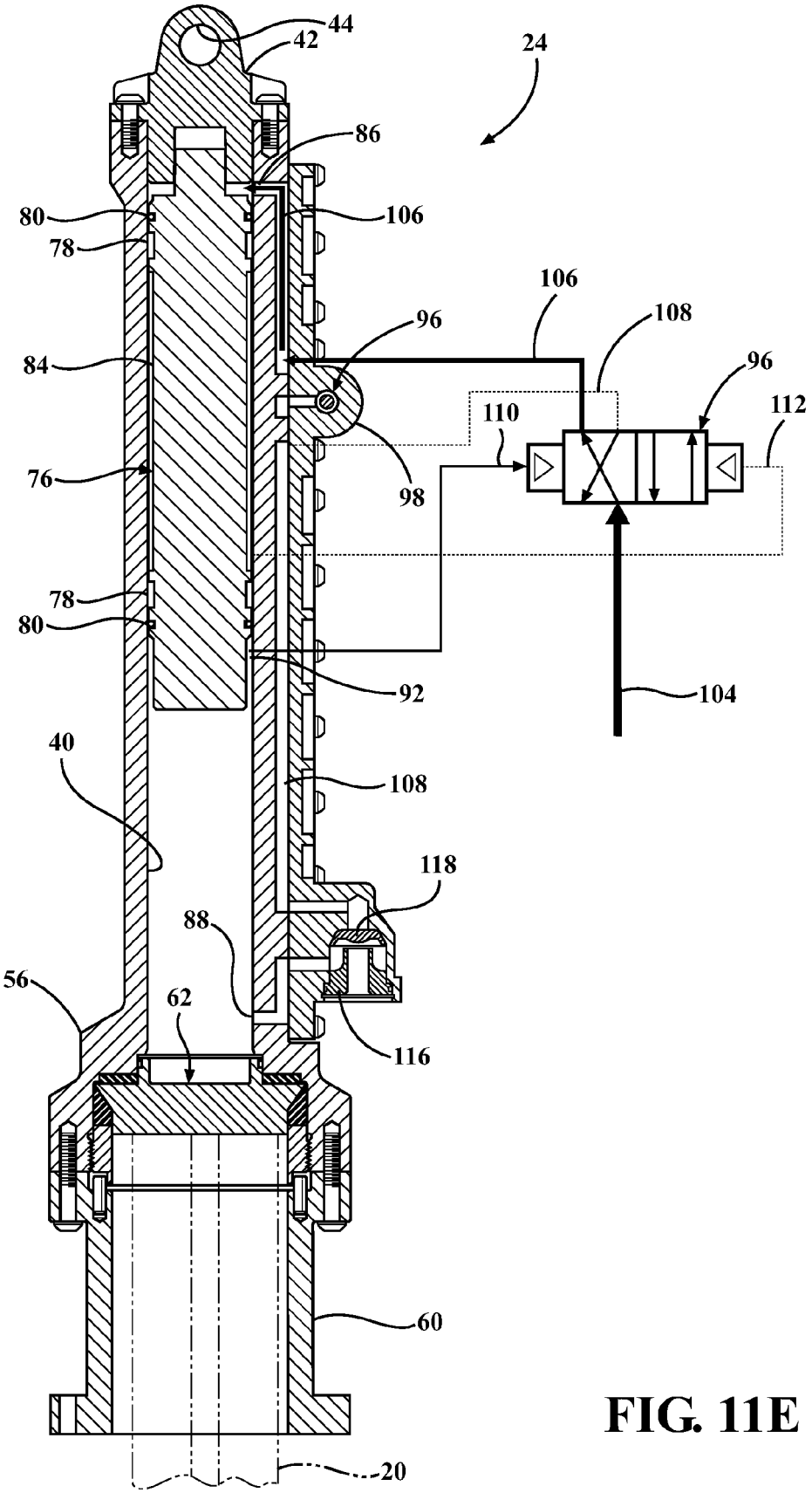

In FIG. 11D, the hammer piston 76 is in up-stroke under the motive force of compressed air filling the cylinder chamber 40 through up-stroke port 88. The control valve 96 remains in the first working position. The reduced diameter central region 84 of the hammer piston 76 concurrently exposes both pilot depressurization port 90 and the first 92 and second 94 pilot ports to external atmosphere, so that pressure exerted on either end of the control valve 96 is released. As the piston ascends through its up-stroke, air above the hammer piston 76 is expelled though the down-stroke port 86, which in turn bleeds back through the control body 98. This semi-flow-restricted exhaust to helps slow up-stoke speed so that the hammer piston 76 travels more slowly on up-stroke compared to its down-stroke speed. Up-stroke speed is further resisted as the hammer piston 76 nears its terminal top dead center position and the nipple 82 enters the pocket 46 in the cap 42 (if so equipped).

The cycle completes with FIG. 11E, which corresponds to FIG. 11A. Here again, the hammer piston 76 is in a full up position. The second pilot port 94 is exposed allowing compressed air from below the hammer piston 76 to urge the control valve 96 toward the second working position (FIG. 9). Air entering the control body 98 via the main air inlet 104 is then directed into the down-stroke passage 106 and into the top of the cylinder chamber 40 via the down stroke port 86 to force the hammer piston 76 back down toward the anvil 62.

Figure 12:
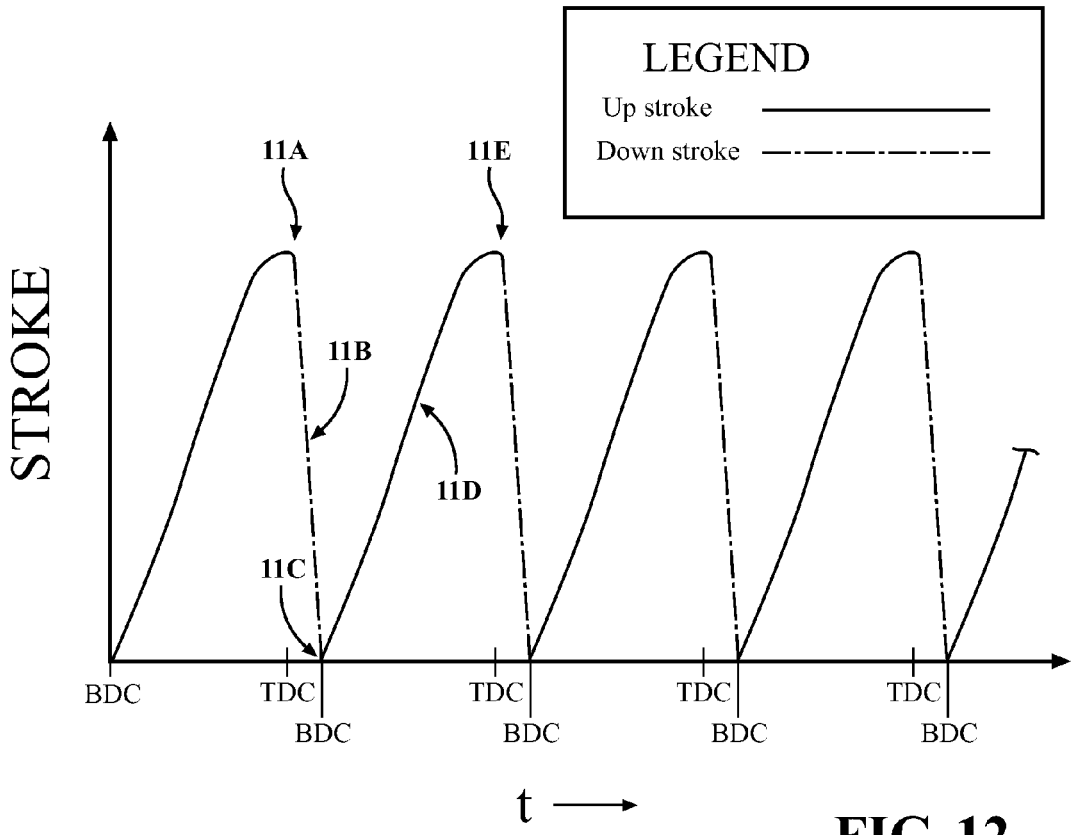
FIG. 12 is simplified graph showing the relative speed of the up-stroke to the speed of the down-stroke of the hammer piston.
Figure 15:
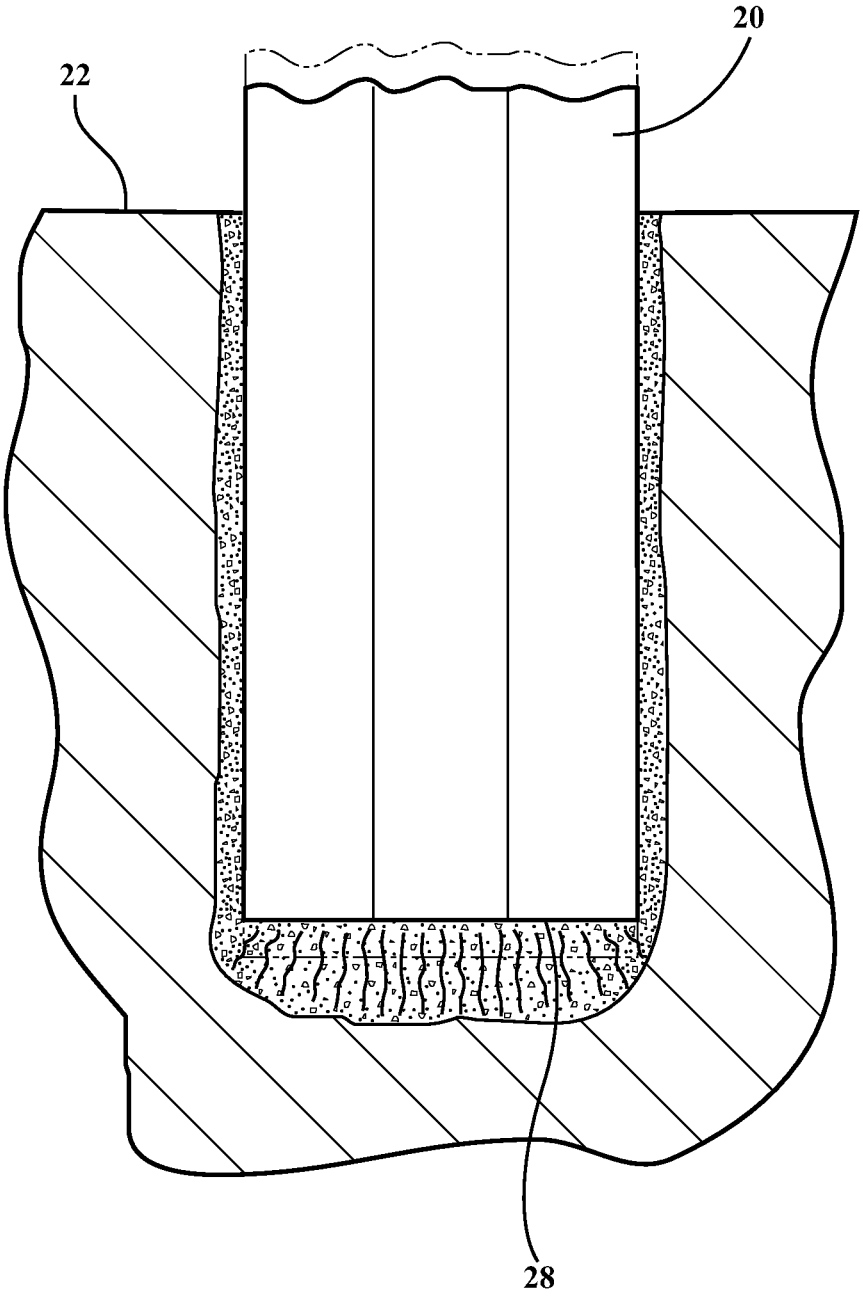
FIG. 15 depicts the lower end or tip of a post as it is driven into the earth by the present apparatus and induces shock waves into the immediately adjacent soil thus facilitating rapid placement.

The cyclic stroke cycle of FIGS. 11A-11E is graphically depicted in FIG. 12. Arrows 11A-11E indicate the approximate positions where the respective illustrations of FIGS. 11A-11E would correspond to the graph. As will be apparent, the up-stroke time is considerably greater (i.e., slower) that the down-stroke time. Or said another way, the hammer piston 76 travels much faster in down-stroke than in up-stroke thus maximizing the impact force transferred to the anvil 62 and post 20 yet softening the recoil at top dead center direction reversal. Hammering against the anvil 62 can be accomplished at relatively high cycle rates, for example in the order of 180-200 strokes per minute. At these rates, and coupled with the resilient mounting arrangement of the anvil 62, a shock wave can be generated through the leading tip 28 of the post 20. This shock wave, which is illustrated in FIG. 15, has the effect of sonically loosening the soil as the post 20 advances into the earth 22. Under most conditions, the sonically loosened soil will then permit the post 20 to slide into the earth with surprising little resistance.

In use, the apparatus 24 is placed so that its anvil 62 rests atop the upper end 26 of a post 20 to be driven into the ground 22. The apparatus 24 is connected to a source of compressed air 36 with an air hose 34. Grasping the handles 48, an operator triggers the flow control valve 52 thus admitting a strong flow of pressurized air to the control valve 96 which in turn causes the internal hammer piston 76 to stroke up and down cyclically beating against the anvil 62. The anvil 62 transfers kinetic energy from the hammer piston 76 to the post 20. The resiliently mounted anvil 62 may be displaced about 0.125 inches upon impact, thus driving the post 20 downwardly a corresponding distance. When operated at a suitable air flow and pressure, a steady hammering rhythm on the order of 180-200 strokes per minute may be maintained, which in turn generates a shock wave that is transmitted along the length of the post 20 to its leading tip 28 in the soil which functions to disrupt and loosen the surrounding soil, thus facilitating advance of the post 20 into the earth 22. The tapered interface between the lower elastomeric pad 74 and the under surface 68 of the anvil retention flange 64 helps maintain a centered condition and a robust compression lock for the anvil 62 in the driver base 56. As a result, this present pneumatic driver apparatus 24 represents a reliable, robust device which consumes very little air pressure and operates very efficiently to transfer a maximum amount of energy in a rapid succession of hits onto a post 20 so that the post 20 can be quickly and fluidly driven into the earth.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A pneumatic post driving apparatus having a reciprocating hammer head, said apparatus comprising:

a housing including an internal cylinder chamber, said cylinder chamber having a side wall defining an internal diameter, a cap enclosing a top end of said cylinder chamber, an anvil enclosing a bottom end of said cylinder chamber, a hammer piston disposed in said cylinder chamber for sliding movement in a longitudinal direction between said cap and said anvil, said hammer piston having an outer diameter measured at a sliding interface with said cylinder chamber, said hammer piston including a central region defined by a reduced diameter less than the outer diameter at said sliding interface, a down-stroke port disposed in said side wall of said cylinder chamber adjacent said cap, an up-stroke port disposed in said side wall of said cylinder chamber adjacent said anvil, a first pilot port disposed in said side wall of said cylinder chamber between said down-stroke port and said up-stroke port, a second pilot port disposed in said side wall of said cylinder chamber between said first pilot port and said down-stroke port, an air control system for alternately routing pressurized air between said top and bottom ends of said cylinder to move said hammer piston up and down therein, said air control system including a control valve, said control valve disposed for movement between first and second working positions in a control body, said control body including a main air inlet configured for connection to a source of compressed air, a down-stroke passage extending between said control body and said down-stroke port, an up-stroke passage extending between said control body and said up-stroke port, a first pilot passage extending between said first pilot port and said control body for routing a flow of air from said cylinder chamber to urge said control valve away from said first working position and toward said second working position, a second pilot passage extending between said second pilot port and said control body for routing a flow of air from said cylinder chamber to urge said control valve away from said second working position and toward said first working position, and a pilot depressurization port extending to atmosphere from said cylinder chamber, said pilot depressurization port disposed in said side wall of said cylinder chamber longitudinally between said first pilot port and said second pilot port, said pilot depressurization port intermittently in direct fluid communication with at least one of said first pilot port and said second pilot port via said reduced central diameter of said hammer piston to intermittently depressurize said first and second pilot passages.

2. The apparatus of claim 1, wherein said control valve comprises a spool valve.

3. The apparatus of claim 2, wherein said control body has first and second ends, said control valve disposed for linear reciprocating movement within said control body between said first and second ends thereof.

4. The apparatus of claim 3, wherein said control valve remains unbiased within said control body toward neither said first nor said second end.

5. The apparatus of claim 3, further including a reset button configured to manually urge said control valve toward one of said first and second ends of said control body.

6. The apparatus of claim 1, wherein said anvil includes an annular retention flange, said retention flange having a conically tapered under surface, a lower elastomeric pad disposed between said housing and said tapered under surface of said retention flange, said lower elastomeric pad having a tapered engagement surface complementing said tapered under surface of said retention flange so that said surfaces meet in direct surface-to-surface contact.

7. The apparatus of claim 6, wherein said retention flange includes an upper surface, an upper elastomeric pad disposed between said housing and said upper surface of said retention flange, said upper elastomeric pad having a flat annular shape.

8. The apparatus of claim 6, wherein said anvil includes a circular rim extending upwardly from said upper surface of said retention flange, said circular rim having an external groove, an O-ring disposed in said groove.

9. The apparatus of claim 1, wherein said up-stroke passage includes a one-way valve for preventing movement of air from said cylinder chamber toward said control valve, and a quick-exhaust dump valve disposed along said up-stroke passage between said up-stroke port and said one-way valve.

10. A pneumatic post driving apparatus having a reciprocating hammer head, said apparatus comprising:

a housing; said housing including an internal cylinder chamber, said cylinder chamber having a side wall defining an internal diameter, a cap enclosing a top end of said cylinder chamber, a pair of handles, said handles arranged on opposing sides of said housing, one of said handles including an internal air conduit, a flow control valve operatively associated with said internal air conduit for selectively stopping the flow of air through said internal air conduit, a quick-connect coupling disposed on a distal end of said one handle for admitting air from a compressed air source to said internal air conduit, said flow control valve having a manual actuator supported on said one handle, said housing including a driver base, a guide tube extending downwardly from said driver base, said guide tube being cylindrical and configured to encircle the upper end of a post to be driven, an anvil disposed within said driver base and enclosing a bottom end of said cylinder chamber, said anvil being fabricated from a solid metallic material, a hammer piston disposed in said cylinder chamber for sliding movement in a longitudinal direction between said cap and said anvil, said hammer piston including a nose configured to forcefully strike said anvil, said hammer piston having an outer diameter measured at a sliding interface with said cylinder chamber, said hammer piston including a central region defined by a reduced diameter less than the outer diameter at said sliding interface, a down-stroke port disposed in said side wall of said cylinder chamber adjacent said cap, an up-stroke port disposed in said side wall of said cylinder chamber adjacent said anvil, a pilot depressurization port extending to atmosphere from said cylinder chamber, a first pilot port disposed in said side wall of said cylinder chamber longitudinally between said up-stroke port and said pilot depressurization port, a second pilot port disposed in said side wall of said cylinder chamber longitudinally between said down-stroke port and said pilot depressurization port, said pilot depressurization port disposed in said side wall of said cylinder chamber longitudinally between said first pilot port and said second pilot port, an air control system for alternately routing pressurized air between said top and bottom ends of said cylinder chamber to move said hammer piston up and down therein, said air control system including a control valve, said control valve disposed in a control body, said control body having first and second ends, said control valve disposed for linear reciprocating movement within said control body between said first and second ends thereof, said control valve being unbiased within said control body toward neither said first nor said second end, a reset button configured to manually urge said control valve toward one of said first and second ends of said control body, said control valve including a main air inlet configured for connection to a source of compressed air, said main air inlet directly connected to said internal air conduit in said one of said handles, and a first pilot passage extending between said first pilot port and said first end of said control body for routing a flow of air from said cylinder chamber to urge said control valve away from said first end and toward said second end, a second pilot passage extending between said second pilot port and said second end of said control body for routing a flow of air from said cylinder chamber to urge said control valve away from said second end and toward said first end, a down-stroke passage extending between said control valve and said down-stroke port, an up-stroke passage extending between said control valve and said up-stroke port, said up-stroke passage including a one-way valve for preventing movement of air from said cylinder chamber toward said control valve, and a quick-exhaust dump valve disposed along said up-stroke passage between said up-stroke port and said one-way valve, wherein said pilot depressurization is intermittently in direct fluid communication with at least one of said first pilot port and said second pilot port via said reduced central diameter of said hammer piston to intermittently depressurize said first and second pilot passages.

* * * * *